US006899029B2

(12) United States Patent
Invernizzi

(10) Patent No.: US 6,899,029 B2
(45) Date of Patent: May 31, 2005

(54) MULTI-LAYERED GAPPED CYLINDRICAL PRINTING BLANKET

(75) Inventor: Gianpierro Invernizzi, Lodi (IT)

(73) Assignee: Reeves, S.p.A., Spartanburg, SC (US)

( * ) Notice: Subject to any disclaimer, the term of this patent is extended or adjusted under 35 U.S.C. 154(b) by 0 days.

(21) Appl. No.: 10/366,362

(22) Filed: Feb. 14, 2003

(65) Prior Publication Data

US 2004/0031407 A1 Feb. 19, 2004

Related U.S. Application Data

(60) Provisional application No. 60/356,146, filed on Feb. 14, 2002.

(51) Int. Cl.[7] ..... B41F 13/10

(52) U.S. Cl. ..... 101/376; 101/216; 101/379; 101/401.1

(58) Field of Search ..... 101/216, 217, 101/401.1, 375, 376, 379

(56) References Cited

U.S. PATENT DOCUMENTS 1,690,684 A * 11/1928 Johnson ..... 138/151
5,351,615 A * 10/1994 Kobler et al. ..... 101/217
6,148,725 A * 11/2000 Knauer et al. ..... 101/217
6,484,632 B2 * 11/2002 Hoffmann et al. ..... 101/217
6,640,711 B2 * 11/2003 Smoot et al. ..... 101/375

* cited by examiner

*Primary Examiner*—Andrew H. Hirshfeld
*Assistant Examiner*—Jill E. Culler
(74) *Attorney, Agent, or Firm*—Dougherty, Clements & Hofer

(57) ABSTRACT

A mountable cylindrical printing blanket apparatus for use with an off-set printing press is provided. The printing blanket has an inner carrier sleeve layer; a printing blanket affixed to the sleeve with at least one compressible layer having a first porosity, at least one printing face layer, a gap extending axially along the mountable printing blanket and having between about 0.2 millimeters and about 2 millimeters in width and a depth substantially extending through at least one layer; and a compressible sealant therein in an amount sufficient to substantially fill the gap. The compressible sealant has a second porosity and a compressibility in both the radial and the tangential direction such that the compressible sealant has a compressibility greater than the compressibility of the compressible layer.

22 Claims, 12 Drawing Sheets

MULTI-LAYERED GAPPED CYLINDRICAL PRINTING BLANKET

This application claims the benefit of Provisional Application No. 60/356,146, filed Feb. 14, 2002.

FIELD OF THE INVENTION

This invention relates generally to compressible printing blankets mounted on a cylinder and having a gap, and in particular relates to a compressible sealant having porosity used in the gap.

BACKGROUND OF THE INVENTION

The use of blankets in printing techniques such as, for example, offset lithography, is well known, wherein such blankets have a primary function of transferring ink from a printing plate to paper. Such printing blankets are very carefully designed so that the surface of the blanket is not damaged, either by mechanical contact of the blanket with the press or by chemical reaction with the ink ingredients or other solvents used in the printing process. Repeated mechanical contacts do cause a certain amount of compression of the blanket, however, which must be maintained within acceptable limits so that the image is properly reproduced. It is also important that the blanket have resiliency, i.e., that it be capable of eventually returning to its original thickness, and that it provide image transfer of a constant quality regardless of the amount of use to which the blanket is put.

Printing blankets typically comprise, on their lower surface, a substrate or base material which provides integrity to the blanket. Woven fabrics are preferred for forming this base. The base may consist of one or more layers or plys of fabric (the terms "layer" and "ply" are used interchangeably herein). The printing, or "working" surface at the top of the blanket, i.e., the surface that actually contacts the ink, is usually a layer of an elastomeric material such as rubber. As used herein, the terms "upper" or "top" relate to that portion of an individual ply, or of the blanket itself, furthest removed from the cylinder of the printing press when the blanket is installed thereon. Alternately, "lower" or "bottom" is used to refer to those portions of either an individual ply or the blanket which would be most closely adjacent the cylinder upon installation of the blanket.

Printing blanket sleeves with rubber sleeves having an inner carrier sleeve are disclosed, for example, by U.S. Pat. Nos. 5,429,048, 5,323,702, 5,440,981 and 5,304,267. One disadvantage of these known rubber cylinder sleeves (transfer cylinder sleeves) is that the middle and lower layers of the same have to be at least partly continuous. This has a particularly detrimental effect on the production costs.

In addition, U.S. Pat. No. 5,351,615 discloses the practice of applying a rubber blanket to a carrier plate, for example by adhesive bonding. After this, this arrangement is shaped into a rubber cylinder sleeve and the mutually facing ends of the carrier plate and those of the rubber blanket or rubber covering are joined to each other, for example by welding or adhesive bonding. Although this arrangement no longer has a gap, a joining seam or a joint location remains on the surface.

In the rubber cylinder sleeve shown in U.S. Pat. No. 5,429,048, its outer layer is continuously sleeve-like and consists of an incompressible material. Apart from the higher production costs already mentioned, a continuous outer layer has the disadvantage that, during rolling contact with a plate cylinder and an impression cylinder, the rubber blanket sleeve is loaded with tangential forces to which further forces are added with each revolution. High loading on the rubber blanket sleeve is established. This loading also has a detrimental effect on the printing quality (for example by a tendency to slippage of the rubber blanket sleeve in relation to the web to be printed in the press nip, and in the rolling nip with a plate cylinder).

None of these sleeves, however, possess a multilayer gap filled with a compressible sealant. Compressible layers in a printing blanket and different ways of producing compressible layers within a printing blanket are known in the art. For example, compressible layers have been formed by mixing granular salt particles with the polymer used to produce the layer, and thereafter leaching the salt from the polymer to create voids therein. Such a method is disclosed in Haren et al. U.S. Pat. No. 4,025,685. The voids in the underlying compressible layer thus permit positive displacement of the surface layer without causing distortion thereof since volume compression occurs and displacement takes place substantially perpendicularly to the impact of the press.

Other methods, such as the use of compressible fiber structures, have also been tried heretofore to produce compressible layers. Examples are found in Duckett et al. U.S. Pat. Nos. 3,887,750 and 4,093,764. Rodriguez, U.S. Pat. No. 4,303,721 teaches a compressible blanket made using blowing agents to create voids in the compressible layer. A further method, involving the use of rubber particles to create voids, is disclosed in Rhodarmer U.S. Pat. No. 3,795,568.

Forming voids with the use of blowing agents has the disadvantages, however, that the size of the voids to be formed, and the interconnection of such voids, is not easily controlled. Oversized voids and interconnected voids cause some areas of the printing blanket to be more compressible and less resilient than adjacent areas, which results in the occurrence of deformations during printing. Moreover, the salt leaching technique described above also has disadvantages in that the particle sizes used are limited, and the process is difficult, time consuming and expensive.

More recently, it has been found preferable to produce printing blankets having a compressible layer comprising a cellular resilient polymer having cells or voids in the compressible layer formed with the use of discrete microspheres. It has been found particularly advantageous to produce a compressible layer by incorporating hollow thermoplastic microspheres in the polymer, as illustrated by Larson U.S. Pat. No. 4,042,743. These microspheres are resilient and thus impart good compressibility properties to the layer.

However, in prior art methods of producing a compressible layer employing thermoplastic microspheres for a printing blanket, it has been found that the thickness of the compressible layer to be formed is not easily controlled since typical thermoplastic microspheres will melt at normal processing and vulcanizing temperatures. Since the microspheres melt before the vulcanization is complete, and before the compressible layer achieves a set structure, agglomeration of the voids created by the microspheres occurs, and size variations in the voids also occur. This can affect the overall performance properties of the blanket. Also, the variations in the sizes of the voids can weaken the printing blanket, causing it to wear out prematurely.

Gaworowski et al. U.S. Pat. No. 4,770,928 attempted to solve these problems by incorporating into the elastomeric compounds utilized to form a matrix for the microspheres within the compressible layer, an accelerator capable of permitting vulcanization of the elastomeric compound at a temperature below the melting point of the microspheres. The use of such relatively low temperatures during the vulcanization process, however, results in the need for additional periods of vulcanization with a concurrent increase in the cost, i.e., including that of the accelerator, and complexity of blanket manufacture.

Shrimpton et al. U.S. Pat. No. 3,700,541 and its corresponding British patent No. 1,327,758 disclose that microspheres made of high temperature thermosetting plastics allow the layer to be cured using conventional high temperature vulcanization processes. However, these microspheres are less resilient than thermoplastic microspheres, so that compressibility properties of the layer are compromised.

SUMMARY OF THE INVENTION

In a first embodiment the invention includes a mountable cylindrical printing blanket apparatus for use with an off-set printing press, said printing blanket apparatus comprising:

an inner carrier sleeve layer a printing blanket affixed to the sleeve and comprising:

at least one compressible layer having a first porosity;

at least one printing face layer;

a gap extending axially along the mountable printing blanket being between about 0.2 millimeters and about 2 millimeters in width and a depth substantially extending through at least one layer; and a compressible sealant therein in an amount sufficient to substantially fill the gap, said compressible sealant having a second porosity and having a compressibility in both the radial and in the tangential direction, and wherein the compressible sealant has a compressibility greater than the compressibility of the compressible layer. The width and depth of the gap are necessary to allow the highly compressible sealant material to have sufficient tangential compressibility to relieve bulge buildup before the rollers.

The printing blanket apparatus in one embodiment has a gap between about 0.2 millimeters and about 2 millimeters in width. Advantageously the compressible sealant has a compressibility greater than 1.5 times the compressibility of the compressible layer.

Alternately or additionally, the printing blanket apparatus further comprises at least one reinforcing layer comprising a fabric, wherein the gap has a depth substantially extending through the at least one reinforcing layer, and the compressible sealant has a hardness of between about 50 and about 100 Shore A.

Alternately or additionally, the compressible porosity in the compressible sealant and in the compressible layer each comprises hollow compressible microspheres, such that the concentration of microspheres in the compressible sealant is between about 1.25 to about 3 times greater than the concentration of microspheres in the compressible layer.

Alternately or additionally, the printing blanket apparatus gap is between about 0.3 millimeters and about 1 millimeter in width and has a depth substantially extending through at least the printing face layer.

Alternately or additionally, the printing blanket apparatus further comprises at least one reinforcing layer comprising a fabric, wherein the gap is between about 0.3 millimeters and about 1 millimeter in width and has a depth substantially extending through at least one reinforcing layer.

Alternately or additionally, the printing blanket apparatus further comprises at least one reinforcing layer comprising a fabric, wherein the gap is between about 0.3 millimeters and about 1 millimeter in width and has a depth substantially extending through at least the printing face layer and one reinforcing layer.

Alternately or additionally, the compressible sealant comprises a moisture-curable polyurethane and microspheres. Alternately or additionally, the polyurethane has a hardness of between about 50 and about 100 Shore A. Alternately or additionally, the polyurethane has a viscosity before curing of between about 40 centipoise and between about 5000 centipoise. Alternately or additionally, the porosity in the compressible sealant and in the compressible layer each comprises microspheres, and wherein the compressible sealant comprises microspheres in an amount between 4.5% and about 9% by weight, and wherein the concentration of microspheres in the compressible sealant is at least 25% greater than the concentration of microspheres in the compressible layer. Alternately or additionally, the gap width is between about 0.4 millimeters and about 0.7 millimeters in width. Alternately or additionally, the concentration of microspheres in the compressible sealant is from about 1.5 to about 3 times the concentration of microspheres in the compressible layer.

In another embodiment, the compressible sealant comprises a vulcanization-curable rubber formulation and microspheres. In such a case, the porosity in the compressible sealant and in the compressible layer each comprises microspheres, and the compressible sealant comprises microspheres in an amount between 4.5% and about 9% by weight, and the concentration of microspheres in the compressible sealant is at least 25% greater than the concentration of microspheres in the compressible layer. In one preferred embodiment, the gap width is between about 0.4 millimeters and about 0.7 millimeters in width. Alternately or additionally, the concentration of microspheres in the compressible sealant is between about 1.5 to about 3 times greater than the concentration of microspheres in the compressible layer. In another embodiment, the vulcanization-curable rubber formulation has a hardness of between about 50 and about 140 Shore A after vulcanization, wherein said hardness is measured without the presence of microspheres.

In yet another embodiment, the invention relates to a mountable cylindrical printing blanket apparatus for use with an off-set printing press, said printing blanket comprising:

an inner carrier sleeve layer;

a printing blanket affixed to the sleeve and comprising:

at least one compressible layer comprising a first concentration of microspheres;

at least one reinforcing layer comprising fabric;

at least one printing face layer;

a gap extending axially along the mountable printing blanket and having between about 0.2 millimeters and 0.9 millimeters in width and has a depth substantially extending through the printing layer and at least one reinforcing layer; and a compressible sealant therein in an amount sufficient to substantially fill the gap, said compressible sealant having a second porosity and having a compressibility in both the radial and in the tangential direction, and wherein the compressible sealant has a compressibility at least about 50% greater than the compressibility of the compressible layer. The gap is advantageously between about 0.4 millimeters and about 0.7 millimeters in width, and wherein the compressible sealant comprises moisture-curable polyurethane and microspheres in an amount between 4.5% and about 9% by weight, and wherein the greater than the concentration of microspheres in the compressible sealant is at least 25% greater than the concentration of microspheres in the compressible layer. Alternately or additionally, the gap is between about 0.4 millimeters and about 0.7 millimeters in width, and wherein the compressible sealant comprises vulcanization-cured rubber and microspheres in an amount between 4.5% and about 9°/a by weight, and wherein the concentration of microspheres in the compressible sealant is at least 25% greater than the concentration of microspheres in the compressible layer.

The invention also relates to a method of making the blankets of this invention. Such a method advantageoulsy comprises the step of:

providing a sleeve formed into a cylinder 10 and having an outer face;

providing a substantially cured flat printing blanket having a back face and a printing face on opposing sides and dimensioned to cover one side of the metal sleeve;

affixing a layer of adhesive and a release layer to at least one of the back face of the printing blanket, to the outer face of the sleeve, or to both;

removing the release layer and affixing the printing blanket back face onto the outer face of the sleeve;

using an opposing roller to apply pressure to the printing face of the blanket to squeeze out any air bubbles entrapped between the blanket and the sleeve;

optionally cut any excess printing blanket off so as to leave a gap of between two opposing edges of the printing blanket, wherein said gap is between about 0.2 millimeters and about 2 millimeters in width;

optionally cure the adhesive;

adding a compressible sealant into the gap, wherein the compressible sealant comprises between about 4.5% and about 10% by weight of the compressible sealant;

grinding of the surface of at least the compressible sealant to be flush with the top of the printing face.

Other details, features, objects, uses, and advantages of this invention will become apparent from the embodiments thereof presented in the following detailed description, drawings and claims.

DESCRIPTION OF THE PREFERRED EMBODIMENTS

Figure 1:
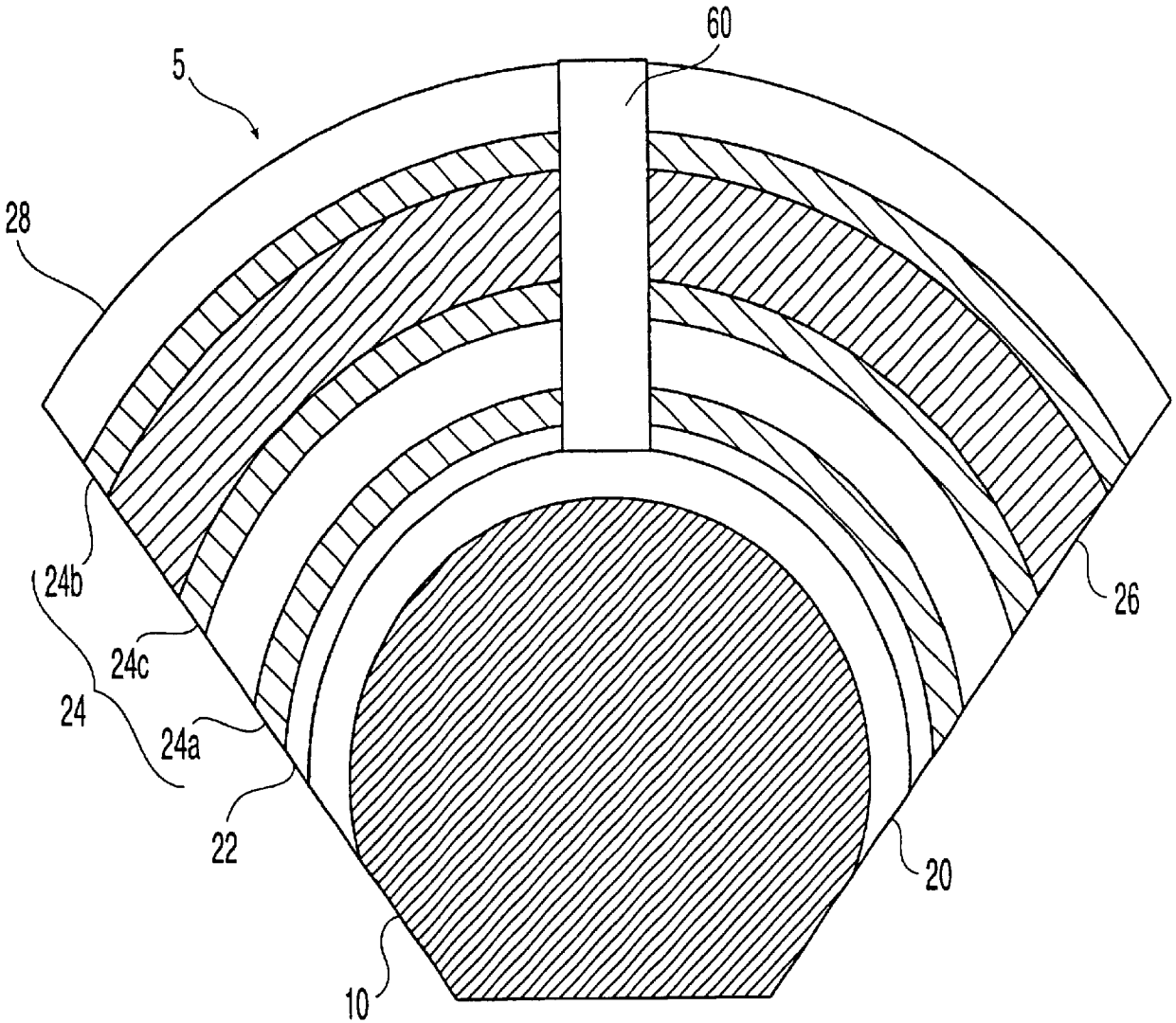
FIG. 1 illustrates a cross section of atypical printing blanket which includes a compressible layer formed according to the present invention.

Reference is now made to FIG. 1 which illustrates a typical printing blanket 5 that includes a compressible layer 26 formed according to the present invention. The laminated printing blanket 5 includes, from top to bottom, at least a top surface layer 28, a reinforcing fabric layer 24*b*, the compressible layer 26, and at least one fabric substrate ply 24 (c and a, in this drawing), an adhesive layer 22, a nickel metal sleeve 20, and a compressible sealant 60. Those skilled in the art will recognize that the number and types of layers used, particularly the number of fabric layers positioned above and below the compressible layer, can vary depending on the uses to which the blanket is to be put. The gap into which the compressible sealant is formed can extend into any all of the layers of the printing blanket.

Compressible layer 26 is formed of an elastomeric compound having the usual processing, stabilizing, strengthening and curing additives, which need not be described herein as they are all well known in the art, and is formulated with reference to its specific application. Moreover, as is also known in the art, this formulation is different than the one used for the printing surface since the two layers require different attributes. Any suitable polymeric material, such as a rubber or rubber blend compound, which is considered a curable or vulcanizable material can be used to form the compressible layer; for example, natural rubber, styrene-butadiene rubber (SBR), EPDM (ethylene/-propylene/non-conjugated diene ter-polymer rubber), butyl rubber, butadiene, acrylonitnle rubber (NBR), polyurethanes etc. An elastomer which is resistant to solvents and inks is most preferable, such as 100% nitrite. Alternately, a blend of nitrite and neoprene such as 40/60 nitrite: neoprene may also be used.

The fabric layers 24*a*, 24*b*, and 24*c*, comprised of warp fibers 55 and fill fibers 57, should be made of plain woven fabric of lower extensibility in the warp direction, i.e., the direction longitudinal to the machining of the blanket, and are typically high grade cotton yarns, which are free from slubs and knots, weaving defects, seeds, etc. The fabric may also be a synthetic material such as rayon, nylon, polyester or mixtures thereof. Typically, a fabric layer will be about 0.003 to 0.016 in. thick. Fabrics suitable for use in forming printing blankets comprising the compressible layer of the present invention (in addition to those set forth in the Example provided below) include but are not limited to those disclosed in Larson et al. U.S. Pat. No. 4,042,743, the disclosure of which is incorporated herein by specific reference hereto.

Lowermost fabric ply 24*a*, and optionally, the other fabric ply(s) such as, e.g., fabric ply 24*c*, is thoroughly saturated with a coating material to render the fabric ink, water and solvent repellant. The coating material is preferably a fluorocarbon having either a solvent or a water base and is of such low viscosity, i.e., essentially the same as water, that complete penetration of the fabric ply(s) so treated is possible. This coating treatment effectively eliminates the possibility of wicking through interior channels within the fabric. Thus it is no longer necessary, as practiced in the prior art, to seal the cut edges of the blanket. Alternately, numerous other treating materials, such as silicone compounds having similar water and solvent-resistant properties, may be utilized in place of the fluorocarbon material.

In place of the fabrics described above for use in forming the fabric plys for inclusion within a printing blanket comprising the compressible layer of the present invention, one could substitute a variety of alternate fabrics, both natural and synthetic, including those having a fiber count different from that disclosed in the Example set forth below, as long as these materials possess the requisite degree of stretch and tensile strength. Still further, materials such as porous plastic, paper, or rubber sheets having the appropriate characteristics may also be substituted for the above discussed fabrics.

The compressible layer 26 is formed by dispersing within the elastomeric compound described above a plurality of high melting point thermoplastic microspheres and applying the resultant mixture to an upper surface of a fabric substrate ply, preferably by spread coating. In the preferred technique, the elastomeric compound is first brought to the desired consistency for spreading by adding a solvent. Then, a number of layers of the compound are spread onto the fabric to make a compressible layer 26 of the desired thickness. As each layer is applied, it is solidified, but not crosslinked. Compressible layer 26 may have a thickness of between about 0.004 to 0.030 inches, although it is preferred that the layer be about 0.011 to 0.012 inches thick. Alternately, calendaring, extruding, dipping or any other known means for contacting the fabric with the elastomeric matrix containing the microspheres may be used if desired in place of the spread coating technique.

The microspheres for use with the present invention are formed, as noted above, from a thermoplastic resin. One requirement, however, is that the specific thermoplastic resin(s) must be and remain stable at "high" temperatures, i.e., above about 135 C. (275 F.), to enable processing at typical blanket curing temperatures without melting, deforming or otherwise degrading. The terms "high melting" and "high melting point" are utilized throughout this specification to refer to such materials.

As noted above, the prior art teaches that low melting thermoplastic microspheres are resilient but possess a processing disadvantage in that special procedures, (e.g., an extended vulcanization time) are needed to properly set the microspheres within the matrix prior to vulcanization. In addition, the prior art also teaches that thermosetting microspheres can be used without concern as to the vulcanization step, but that these microspheres are not as resilient as the thermoplastic microspheres. The present invention provides a substantial improvement over these prior art compressible layers because the high melting thermoplastic microspheres have better resiliency than the thermosetting microspheres, and also permit the use of short, high temperature vulcanization procedures without concern as to degradation of the microspheres.

High melting point thermoplastic resins which are acceptable for use with the present invention include, but are not limited to, vinylidine halide homopolymers and copolymers, particularly those of vinylidine chloride with vinyl chloride, acrylates or nitrites; fluoroplastics such as PTFE (polytetrafluoroethylene), FEP (fluorinated ethylene propylene) copolymers, perfluoroalkoxy (PFA) resin, PCTFE (polychlorotrifluoroethylene), ECTFE (ethyl enechlorotrifluoroethylene) copolymer, ETFE (ethylene-tetrafluoroethylene) copolymers, PVDF (polyvinylidine fluoride), PVF (polyvinyl fluoride); PAEKs, i.e., polyaryletherketones; nitnle resins; nylon or polyamide resins; polyamide-imides; polyarylates; polybenzimidazoles; polycarbonates; thermoplastic polyesters such as PBT (polybutylene terephthalate), PCT (polycyclohexylene dimethylene terephthalate) and PET (polyethylene terephthalate); the polyethenmides; PMP (polymethylpentene); modified PPO (polyphenylene oxide); PPS (polyphenylene sulfide); polypropylene; chlorinated PVC (polyvinyl chloride); and mixtures thereof. A variety of acceptable types of thermoplastic microspheres for use with the present invention are currently available on the market.

Preferred microspheres are marketed by Expancel of Sundsvall, Sweden under the tradenames Expancel 091 DE and Expancel 091 DU, with "DE" standing for "dry, expanded" and "DU" standing for "dry, unexpanded". This microsphere comprises a copolymer of acrylonitrile, methacrylonitrile and methyl methacrylate and pentane as the solvent.

The preferred diameter range for the high melting thermoplastic microspheres used in the invention is typically between about 1–200 .mu., and more preferably between about 50 and 130 .mu., with an average size of about 90 .mu., being especially preferred. Generally, the microspheres are uniformly distributed throughout the elastomer by mixing in such a manner as to avoid any appreciable crushing thereof. The microspheres are dispersed within the elastomeric matrix at a loading of between about 1–90%, and preferably 2–70% of the solid contents. This percentage will of course vary based on such factors as microsphere dimension, wall thickness and bulk density. The amount and the size of the specific microspheres used is based on the desired compressibility of the blanket. If desired, the microspheres may further include a coating thereupon to facilitate their bonding with the matrix material. Materials for use in forming such coatings include talc, calcium carbonate, zinc oxide, titanium dioxide, mica, calcium sulfate, barium sulfate, antimony oxide, clay, silica and aluminum trihydrate.

In a preferred embodiment of the invention, therefore, voids of compressible layer 26 are formed with high melting thermoplastic microspheres having a melting point above about 135 C. (275 F.). These microspheres have been found to provide a significantly improved performance during curing, i.e., by permitting the use of substantially higher temperatures for substantially shorter terms than was previously possible with the lower melting microspheres used in prior art blankets and by avoiding the use of accelerating agents. The present invention significantly reduces the curing time for the compressible layer from about 10–12 hours to about four hours, thus reducing both the complexity and the cost of the curing process and therefore the operation as a whole. The vulcanizing process used to cure the compressible layer is described below.

Preferably, the presence of water is avoided during the incorporation of the microspheres in the elastomer in order to avoid water vapor blowing during any subsequent heating of the polymer. For this reason, the microspheres are preferably dried before mixing with the elastomer.

The printing surface layer 28 is formed by the spread coating procedure described above, however, using an elastomeric compound suitable for the working face of the printing blanket. One example of such a compound is a nitrile/polysulfide blend. A number of layers of the elastomeric compound are typically required to make a printing surface layer of the desired thickness. In general, the surface layer will be about 0.005 to 0.025 inches thick, preferably about 0.010 to 0.015 inches in thickness. It is most preferred to provide a surface layer in the range of about 0.012 to 0.015 in. thick.

It is preferred to use adhesive layers 22 to ensure bonding between the different plys in blanket 5. The adhesive layers for bonding the various fabric and elastomeric plys together may be any compatible elastomer, as is known in the art. Preferably, as the adhesive one can utilize the same elastomer that is used for the matrix of the compressible layer. When applying the adhesive to any of the fabric layers, it is usually spread with a knife-over-roll-spreader, although this method may be replaced by any alternate technique which produces the same result. The adhesive is applied in layers until the desired thickness is obtained.

The steps of preparing a printing blanket incorporating the compressible layer of the invention are set forth below. In a typical printing blanket, i.e., "typical" in that it normally contains, at a minimum as described above, at least a fabric substrate 24*b*, a working surface 28, a reinforcing fabric layer 24*a* and a compressible layer 26 positioned between the fabric layer 24*c* and fabric substrate 24*b*, adhesive layers 22, preferably of a compounded nitrile rubber but which may instead be chosen from a variety of water and solvent based adhesives, are used to join the layers together. Adhesive layer 22 is spread on the upper surface of a first fabric substrate 24*b*. Compressible layer 26 is then formed by mixing high melting thermoplastic microspheres with an elastomeric matrix in a ratio of about 1–90% by weight of the elastomeric material and preferably 2–70% by weight for about 30 minutes to form an elastomeric compound; after which the compound is spread onto the adhesive layer.

In general, a number of layers of the compound are required to obtain the desired thickness of the compressible layer, i.e., between about 0.008 and 0.015 inches. Individual layers having a thickness of about 0.002 inches are a suitable thickness for this application.

Still further, the bonding between the fabric substrate ply 24*b* and the compressible layer 26 may alternately or additionally be effected by a chemical reaction occurring between the two layers triggered during a subsequent curing process as described herein.

The compressible layer is then cured. This layer may be festooned within an oven whereupon it is subjected to elevated temperatures of at least about 80 C. to vulcanize the elastomeric compound to a degree sufficient to set the structure of the polymeric matrix with the microspheres fixed in position therein. Alternately, instead of festooning, the compressible layer may instead be cured by the well known drum wrapping technique or by a continuous curing process such as rotocuring or curing using a double belt press.

Vulcanization of the compressible layer on the fabric substrate is performed at a temperature of between about 80–150 C. for a time of between about 1 and 6 hours with lower temperatures requiring longer times. Typically, about 3½–4½ hours at 125–135 C. is sufficient. If desired, the compressible layer may be conditioned, i.e., preheated, in one or more stages at temperatures lower than the vulcanizing temperature prior to commencing the actual vulcanization treatment. This helps to ensure that the entire mass of the compressible layer is uniformly warmed prior to heating at the actual vulcanizing temperature (i.e., about 135 C.) at which the positions of the microspheres becomes substantially fixed within the matrix.

In the preferred embodiment of the invention, substantially all the sites in the elastomeric polymer which forms the compressible layer are substantially completely crosslinked in this vulcanization step (the blanket as a whole undergoes a further vulcanization treatment step, as described below) to provide the preferred elastic modulus and resiliency and other elastic properties of the elastomer. Of course, those skilled in the art will recognize that, in a rubber product, crosslinking is a continuing process, and that no rubber material is ever completely crosslinked. Therefore, those skilled in the art will recognize that the vulcanization process during the cure of compressible layer 26 may be interrupted prior to optimum vulcanization as long as the elastomeric matrix containing the microspheres has set up sufficiently to "freeze" the microspheres in position; while still obtaining an acceptable product. A thus "partially" vulcanized compressible layer may obtain better crosslinking with tile base layer and the printing surface upon formation of the laminated printing blanket. One skilled in the art will also recognize, however, that a compressible layer which has been substantially completely vulcanized, may be crosslinked to the base ply and the surface layer by means of an adhesive specifically formulated for such a purpose.

After curing the compressible layer 26, a second adhesive layer 22 is then spread on the upper surface of compressible layer 26, and onto one side of a reinforcing fabric layer 24*c*. These layers are then bonded thereto by the second adhesive layer. Next, the reinforcing fabric ply 24*c* may be laminated to the lower side of the working surface 28 by means, e.g., of an adhesive layer 22. Bonding of the layers is typically carried out using laminating pinch rollers.

The exact construction of the blanket may of course be varied according to its intended use. For example, two fabric substrate plys may be utilized instead of one, or a third or additional similar layers may be incorporated. When two or more such layers are used they are positioned in adjacent face relation to each other, that is, a lower surface of one such ply rests atop the upper surface of the fabric ply located directly below, with the possible, i.e., optional, addition of an adhesive layer there between to facilitate bonding between the layers. It may also be desired to provide additional reinforcing fabric plys similar to that which is described above, between the working surface and compressible layer 10. Such an arrangement protects the compressible layer from the higher stresses typically found at the printing surface, thus providing an enhanced degree of smash resistance to the blanket.

The resultant blanket assembly is then finally cured by a vulcanization process well known in the art for this purpose, at a temperature of between about 132 C. to 160 C., and preferably 143 C. to 149 C., for one-half hour to 16 hours under pressures ranging from atmospheric to 6 kg/cm.sup.2. These variables will depend on the exact compounding. Moreover, in the blanket vulcanizing step, a relatively smooth paper film having a fine finish may be disposed in contact with the face of the printing blanket, together with a fine talc prior to placing the blanket in the vulcanizing oven. The paper assures the smoothness of the printing blanket since the smoothness of the paper is imparted to the working surface of the printing blanket. For many applications, the finish thus provided to the printing blanket by the paper will be sufficient for its use, and grinding of the surface will not be required. However, if desired, the working surface may be buffed with medium or coarse grit sandpaper to obtain an appropriate surface profile for a particular application. Such surface profiles are typically measured by a device known as a profilometer, which is well known in the art.

As noted above, the curing of the intermediate compressible layer at temperatures above about 80 C. causes the high melting thermoplastic microspheres to be captured in stationary or set positions in the elastomeric matrix. Since the positions of the microspheres are set in the matrix, the positions of the voids created by the microcapsules are thus predetermined by the position of the microcapsules in the matrix. Therefore, when the assembled blanket undergoes the final vulcanization step, the already set structure of the intermediate layer holds its shape and prevents the agglomeration of voids or the collapse of voids in the layer. This fixed position will not change under final processing of the blanket.

Figure 2:
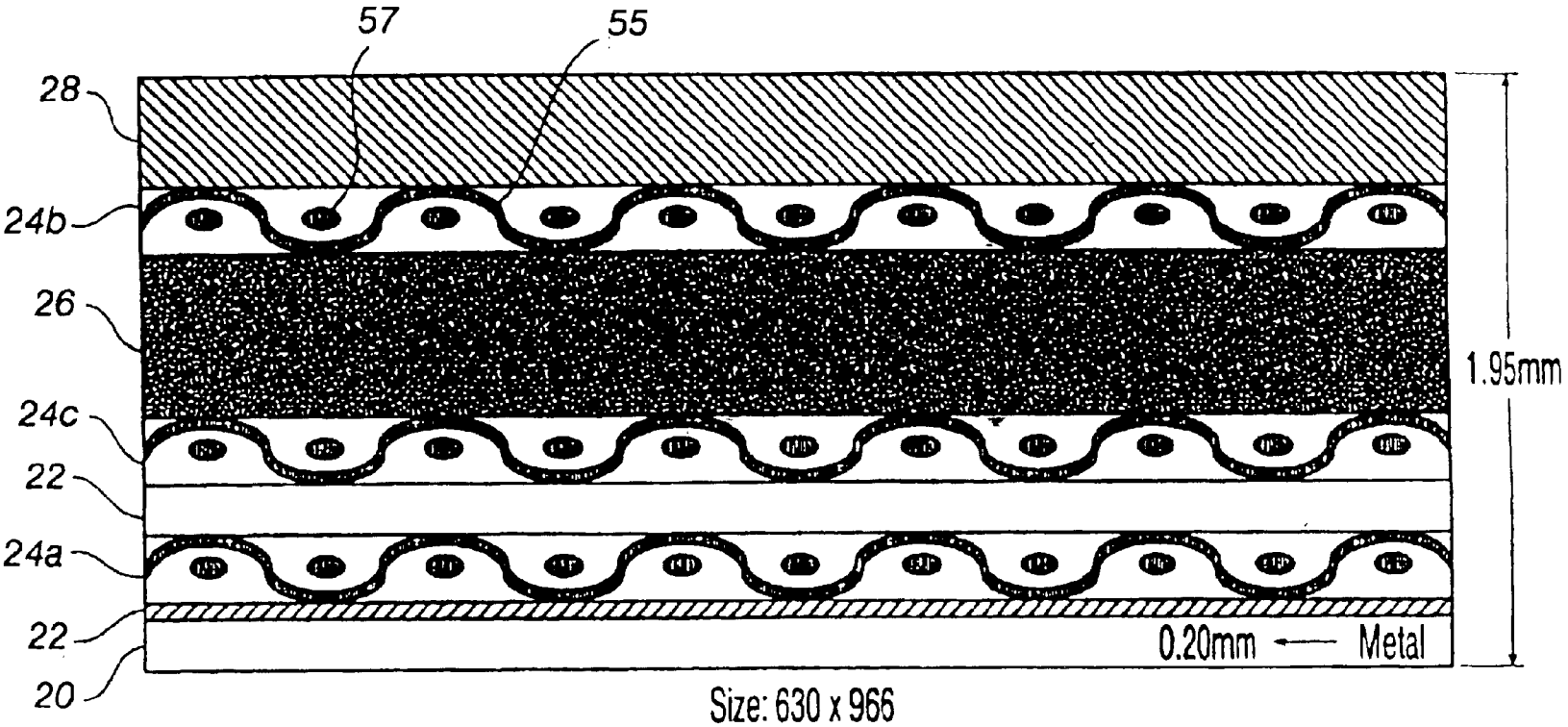
FIG. 2 is a schematic of a printing blanket.

Reference is now made to FIG. 2 which illustrates an embodiment of the invention wherein the blanket dimensions are about 630 mm by about 966 mm, with a total thickness of about 1.95 mm. In this embodiment, the top surface layer 28 is about 0.38 mm thick, the fabric layer 24*b* is about 0.22 mm thick, the compressible layer 26 is about 0.52 mm thick, the fabric layer 24*c* is about 0.2 mm thick, the adhesive layer 22 is about 0.12 mm thick, the fabric layer 24*a* is about 0.25 mm thick the adhesive layer 22 is about 0.06 mm thick, and the nickel metal sleeve layer 20 is about 0.2 mm thick. The fabric layers 24*a*, 24*b*, and 24*c* are comprised of warp fibers 55 and fill fibers 50.

Figure 3:
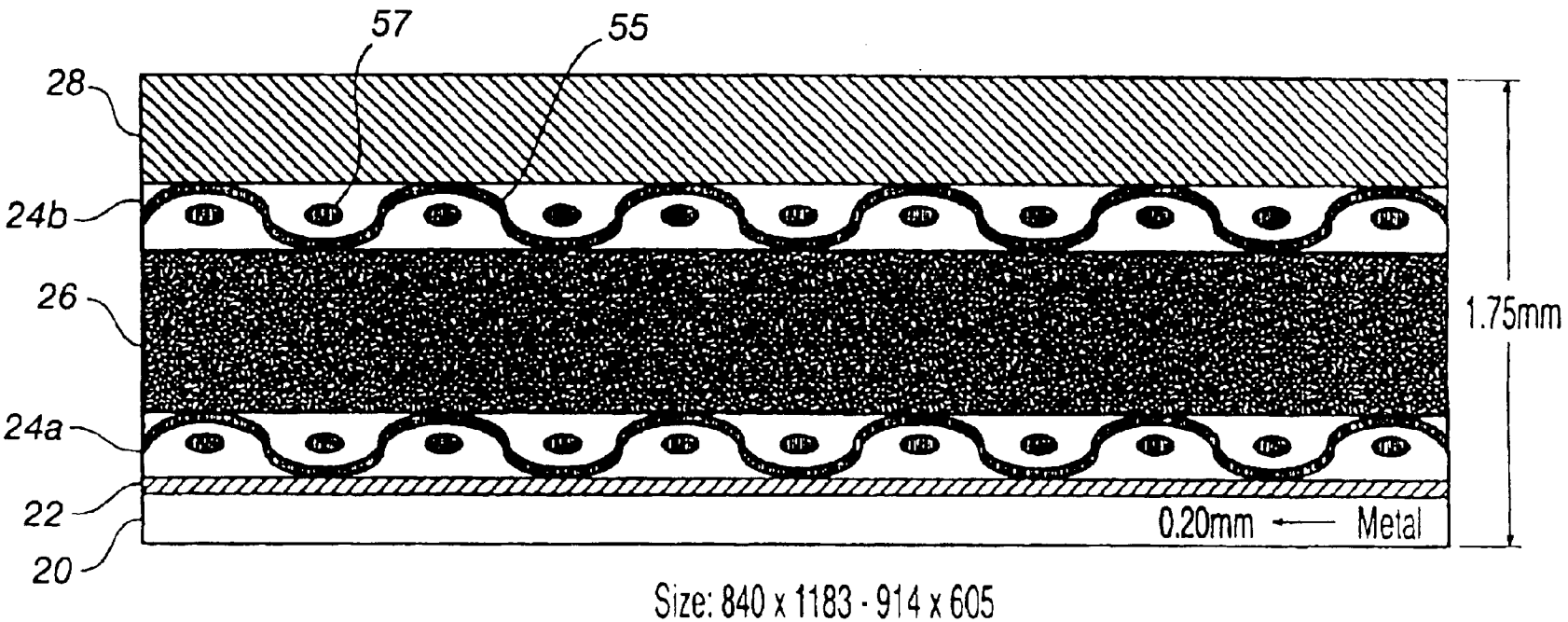
FIG. 3 is a schematic of a printing blanket.

Reference is now made to FIG. 3, which illustrates an embodiment of the invention wherein the blanket dimensions can range from about 840 mm×about 1183 mm to about 914 mm×about 605 mm, with a total thickness of 1.75 mm. In this embodiment, the top surface layer 28 is about 0.53 mm thick, the fabric layer 24*b* is about 0.23 mm thick, the compressible layer 26 is about 0.52 mm thick, the fabric layer 24*a* is about 0.23 mm thick, the adhesive layer 22 is about 0.04 mm thick, and the nickel metal sleeve layer is about 0.2 mm thick. The fabric layers 24*a*, 24*b*, and 24*c* are comprised of warp fibers 55 and fill fibers 50.

Figure 4:
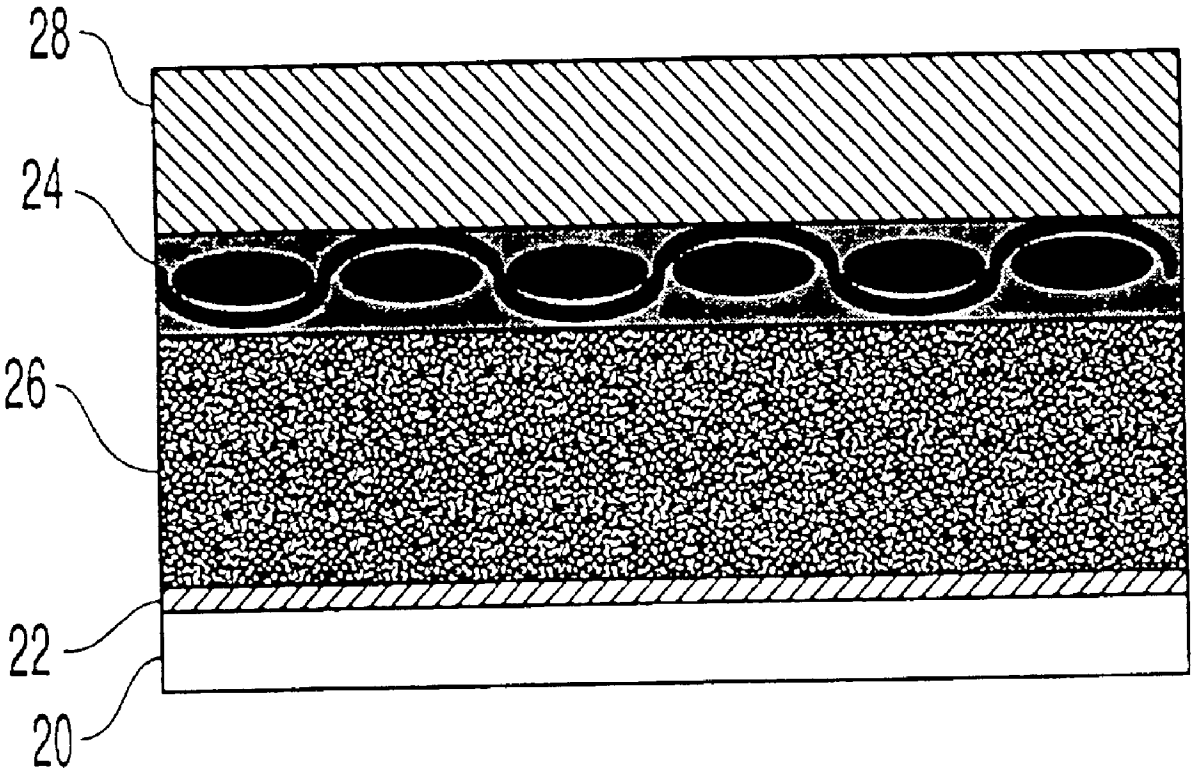
FIG. 4 is a schematic of a printing blanket.

Reference is now made to FIG. 4, which illustrates another embodiment of the invention. In this embodiment, there is a top surface layer 28 which consists of M-516009, a fabric layer 24*b* which consists of cotton, a compressible layer 26 consists of DP-1997M, an adhesive layer 22, and a nickel metal sleeve 20.

Figure 5:
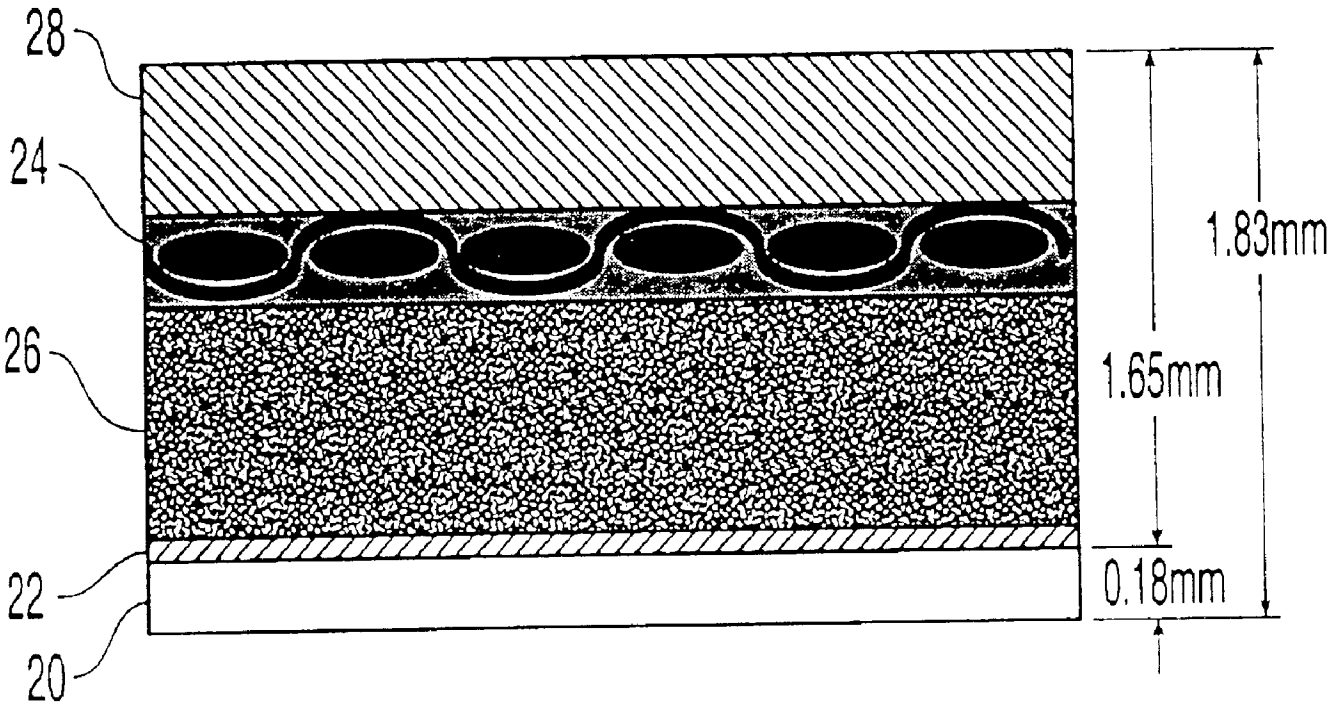
FIG. 5 is a schematic of a printing blanket.

Reference is now made to FIG. 5, which illustrates another embodiment of the invention, wherein the total thickness of the blanket is about 1.83 nun. In this embodiment, the top surface layer 28 is about 0.48 mm thick, the fabric layer 24*b* is about 0.29 mm thick, the compressible layer 26 is about 0.77 mm thick, the adhesive layer 22 is about 0.11 mm thick, and the nickel metal layer 20 is about 0.18 mm thick.

Figure 6:
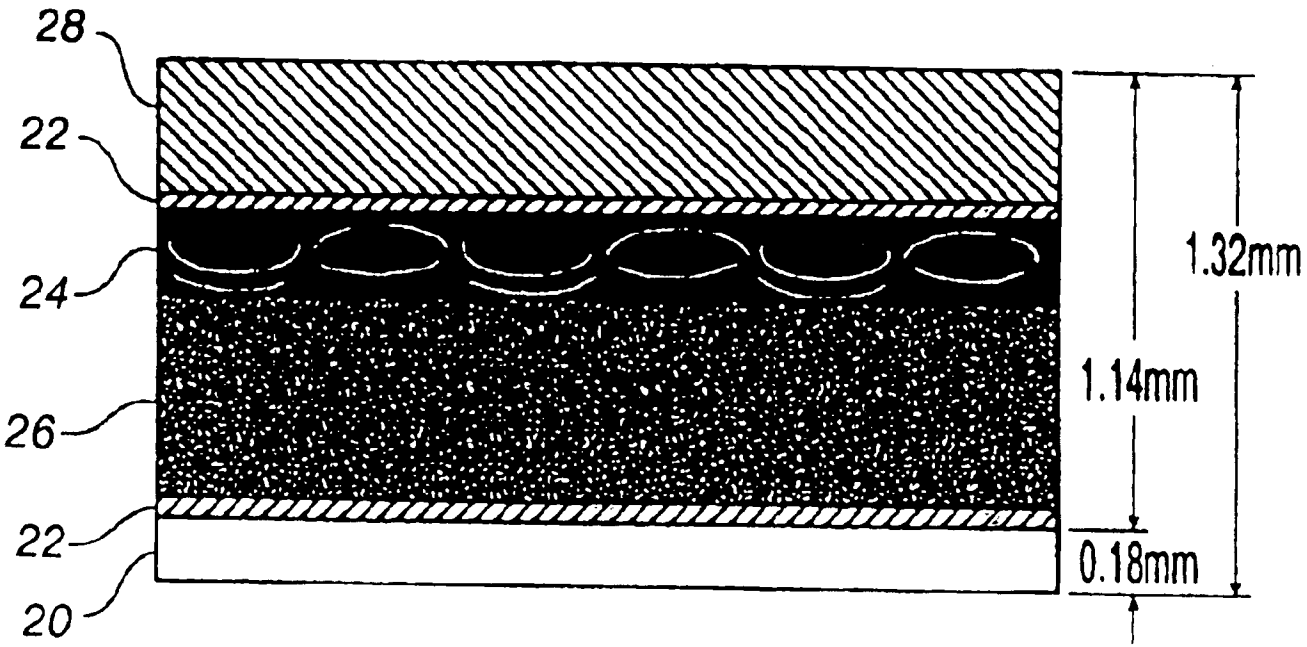
FIG. 6 is a schematic of a printing blanket.

Reference is made to FIG. 6, which illustrates another embodiment of the invention, wherein the total thickness of the blanket is about 1.32 mm. In this embodiment, the top surface layer or buffed printing surface 28 is about 0.37 mm thick, the adhesive layer 22 is about 0.06 mm thick, the fabric layer 24*b* is about 0.16 mm thick, the new compressible layer 26 is about 0.47 mm thick, the next adhesive compound layer 22 is about 0.08 mm thick, and the sleeve is about 0.18 mm thick.

Figure 7B:
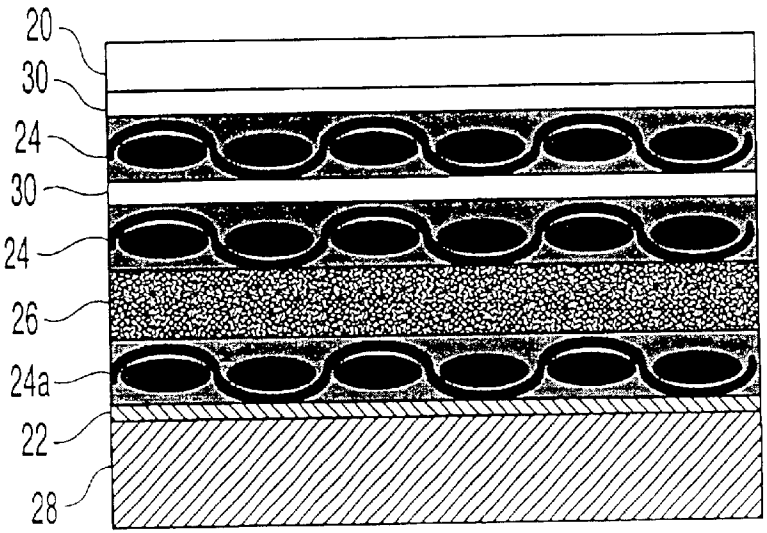
FIGS. 7*a* and 7*b* are schematics of a printing blanket.
Figure 7A:
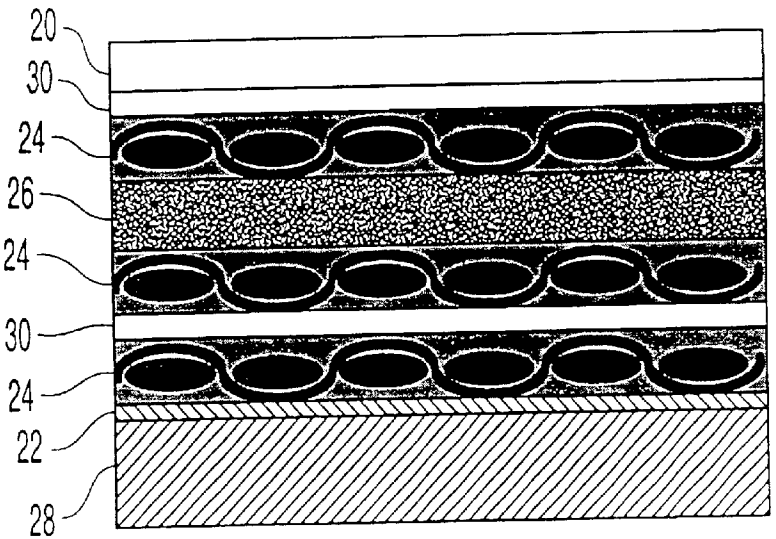

Reference is made to FIG. 7*a*, which illustrates another embodiment of the invention, wherein the layers from top to bottom are the nickel metal sleeve layer 20, the adhesive layer 22, the fabric layer 24*a*, the compressible layer 26, the fabric layer 24*c*, the adhesive layer 22, the fabric layer 24*b*, the adhesive layer 22, and the top surface layer 28. FIG. 7*b* illustrates another embodiment of the invention, wherein the layers from top to bottom are the nickel metal sleeve layer 20, the adhesive layer 22, the fabric layer 24*a*, the adhesive layer 22, the fabric layer 24*c*, the compressible layer 26, the fabric layer 24*b*, the adhesive layer 22, and the top surface layer 28.

Figure 8:
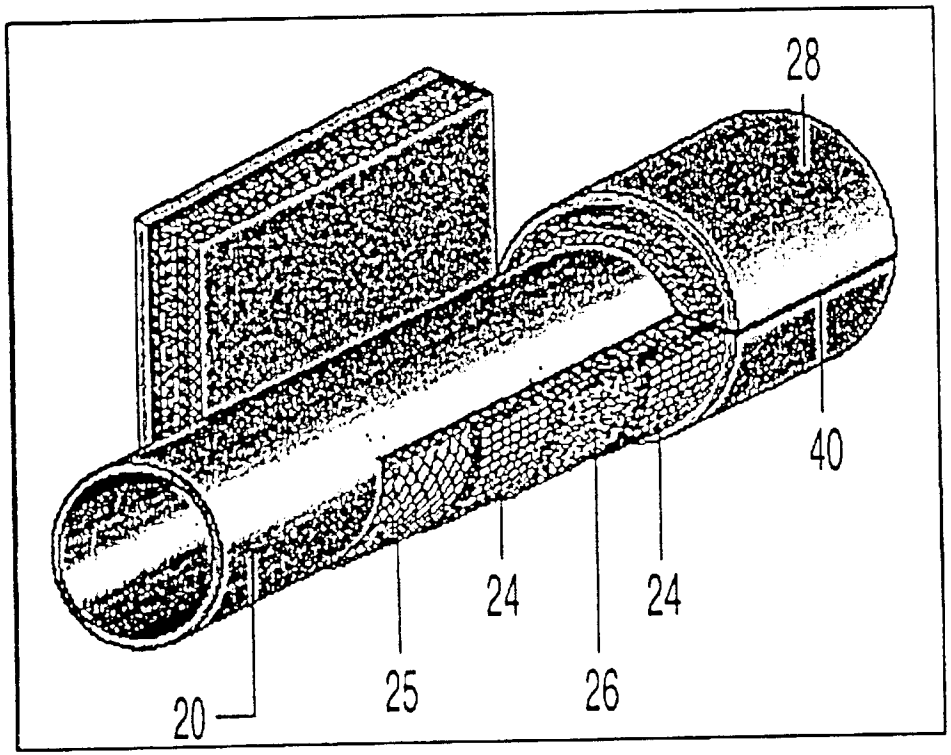
FIG. 8 is a schematic of a printing blanket

Reference is made to FIG. 8, which illustrates an isometric view of the blanket, depicting Nickel sleeve 20, carcass 25, fabric 24*a*, compressible layer 26, fabric 24*c*, sealed gap 40, and top layer 28.

Figure 9:
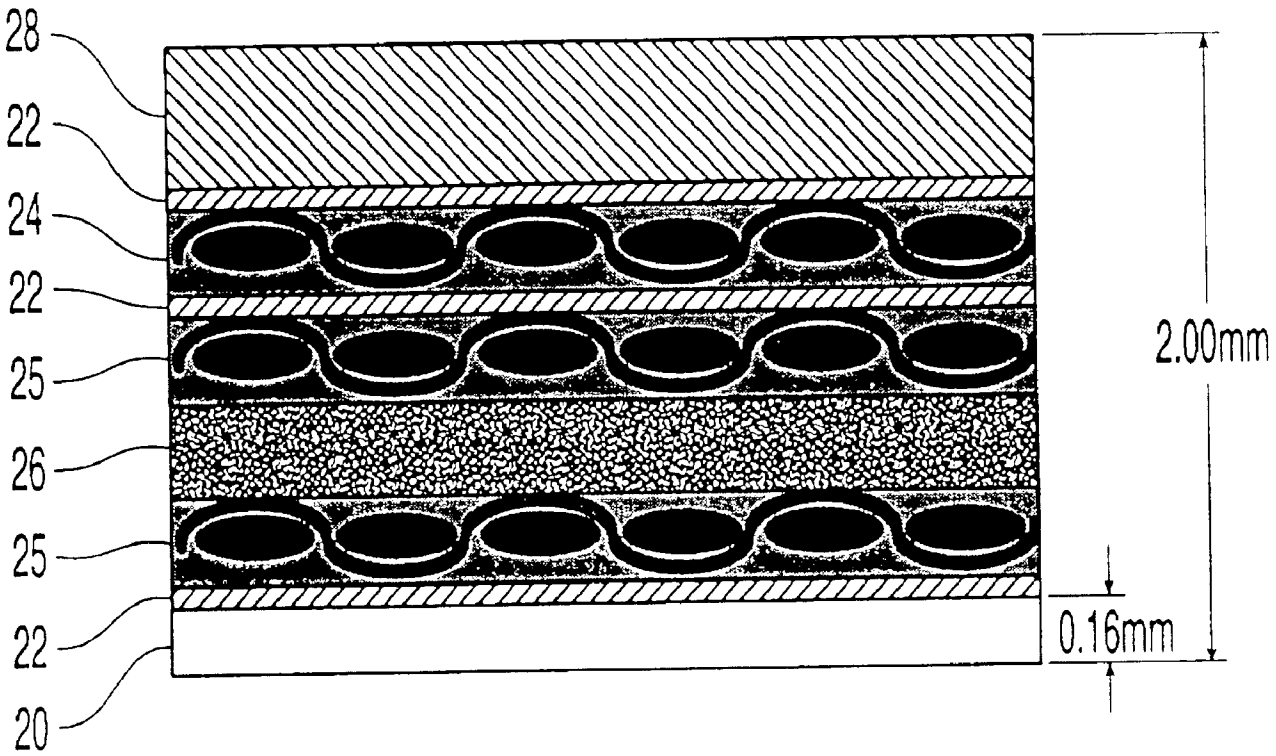
FIG. 9 is a schematic of a printing blanket.

Reference is made to FIG. 9, which illustrates another embodiment of the invention, wherein the total thickness of the blanket is 2.0 mm. In this embodiment, the top surface layer 28 is about 0.32 mm thick, the adhesive layer 22 is about 0.06 mm thick, the first textile layer 24*b* is about 0.26 mm thick, the next adhesive layer is about 0.06 mm thick, the second super stretched fabric layer 24*c* is about 0.28 mm thick, the compressible layer with closed cell 26 is 0.36 mm thick, the 3rd super stretched fabric layer 24*a* is about 0.36 mm thick, the bottom adhesive layer 22 is about 0.13 mm thick, and the nickel sleeve base is about 0.16 mm thick.

Figure 10B:
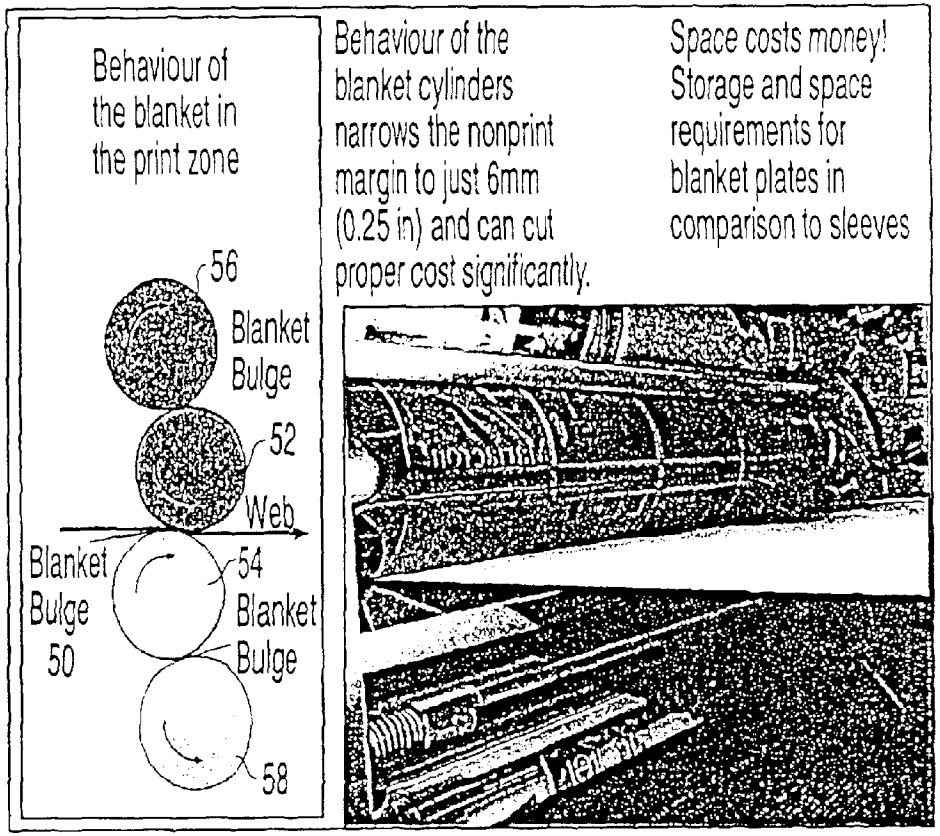
FIG. 10*b* depicts the behavior of a blanket in the print zone.
Figure 10A:
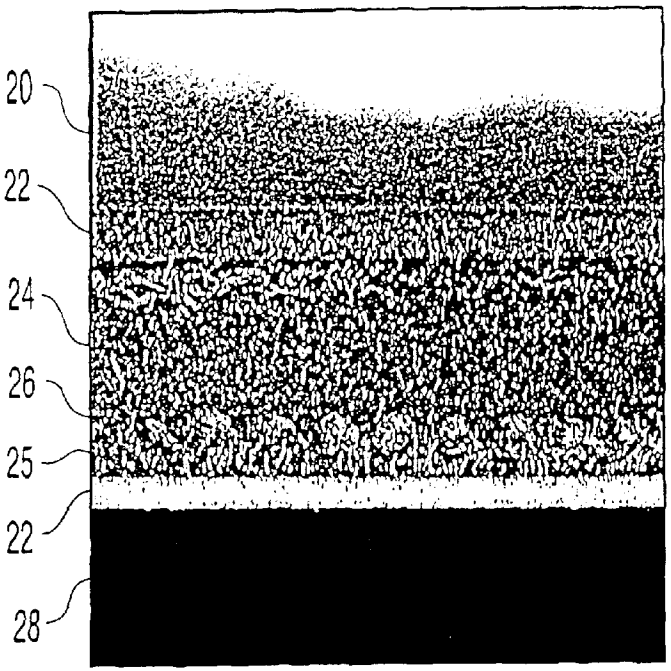
FIG. 10*a* is a schematic of a printing blanket.

Reference is made to FIG. 10*a*, which illustrates a cross-section of the blanket, depicting from bottom to top the nickel metal sleeve layer 20, the adhesive layer 22, the fabric layer 24*a*, the compressible layer 26, the fabric layer 24*b*, the adhesive layer 22, and the top surface 28. FIG. 10*b* also illustrates the behavior of the blanket in the print zone.

Figure 11:
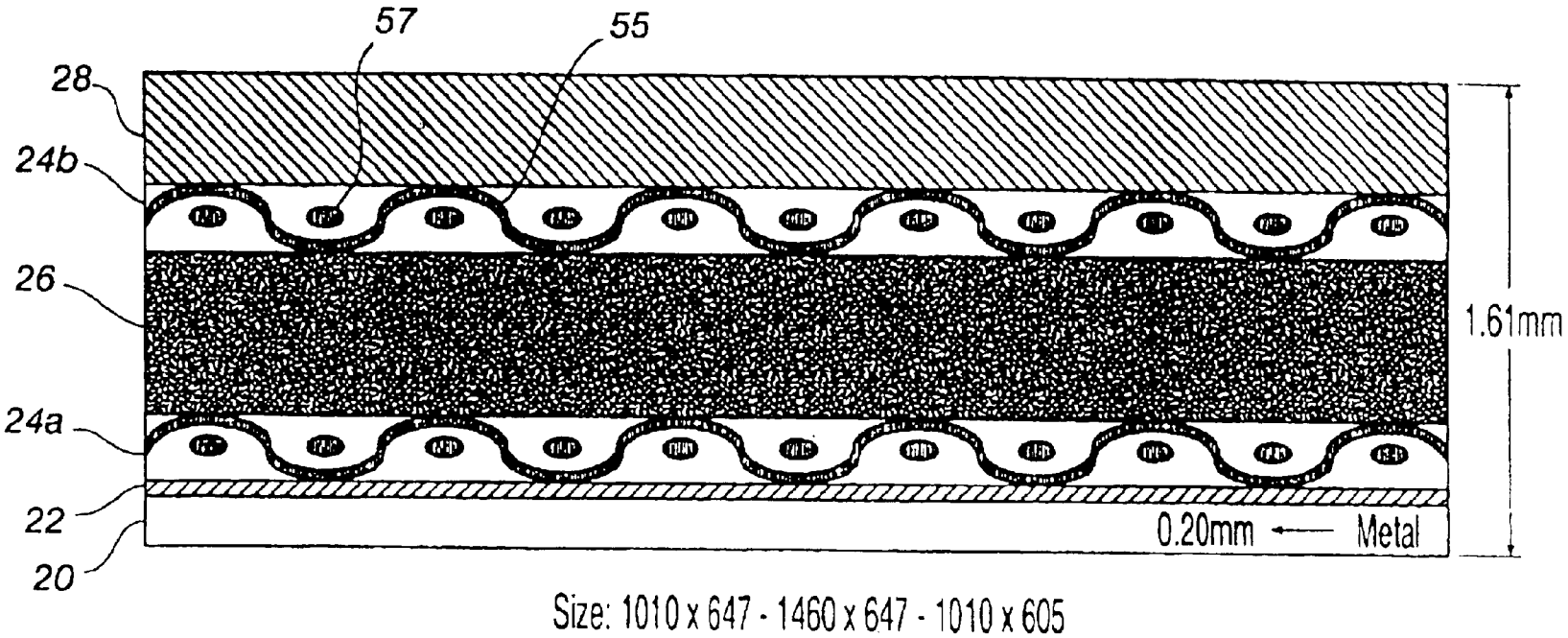
FIG. 11 is a schematic of a printing blanket.

Reference is made to FIG. 11, which illustrates an embodiment of the invention wherein the blanket dimensions are in the range of about 1010 mm×about 647 mm to about 1460×about 647 mm to about 1010×about 605 mm, with a total blanket thickness of 1.61 mm. In this embodiment, the top surface layer 28 is about 0.35 mm thick, the fabric layer 24*b* is about 0.22 mm thick, the compressible layer 26 is about 0.55 mm thick, the fabric layer 24*a* is about 0.24 mm thick, the adhesive layer 22 is about 0.06 mm thick, and the nickel metal sleeve layer 20 about 0.2 mm thick. The fabric layers 24*a* and 24*b* are comprised of warp fibers 55 and fill fibers 50.

Figure 12:
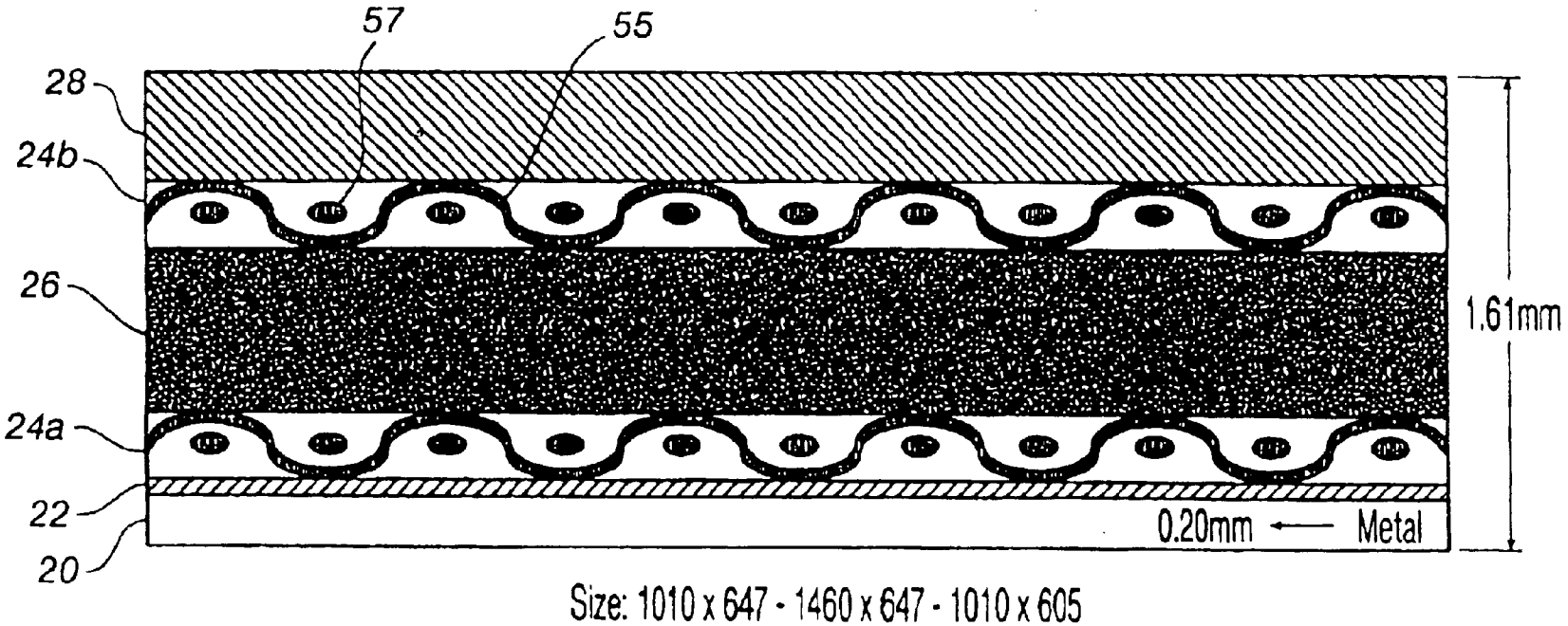
FIG. 12 is a schematic of a printing blanket.

Reference is made to FIG. 12, which illustrates an embodiment of the invention wherein the blanket dimensions are in the range of about 635 mm×about 966 mm, with a total blanket thickness of 1.75 mm. In this embodiment, the top surface layer 28 is about 0.52 mm thick, the fabric layer 24*b* is about 0.23 mm thick, the compressible layer 26 is about 0.52 mm thick, the fabric layer 24*a* is about 0.23 mm thick, the adhesive layer 22 is about 0.06 mm thick, and the nickel metal sleeve layer 20 about 0.2 mm thick. The fabric layers 24*a* and 24*b* are comprised of warp fibers 55 and fill fibers 50.

In a preferred embodiment of the invention, the compressible sealant comprises polyurethanes formed by the reaction of a diisocyanate and a polyol. Preferred diisocyanates can include toluene diisocyanate, methylene bisphenyl isocyanate, hexamethylene diisocyanate, and isophorone diisocyante. The resultant polyurethane is self-curing and requires no vulcanization. The polyurethane must have a viscosity of about 0.5 to 200 centipoise prior to curing to be able to flow into the narrow gap and form the compressible sealant. The microspheres are incorporated into this polyurethane-based compressible sealant prior to the curing process. The resulting hardness of the cured compressible sealant of the present invention is in the range of about 50 Shore A to about 90 Shore A, and more preferably in the range of about 60 Shore A to about 75 Shore A. Such levels are relatively soft compared to most polymers.

The compressible sealant of the present invention has several advantages over the prior art. One is its excellent compression set. This parameter is measured by compressing a polymer to 75% of its original volume and holding the polymer in this compressed state at 70 degrees C. for 72 hours. The pressure is then released from the polymer and the recovery volume is measured. Recovery volumes on the order of 90% are considered excellent for polymers that can be used as compressible sealants in a printing blanket. The polymers of the present invention recover to around 95% of their initial volume in this test.

Another advantage of the compressible sealant of the present invention is its swelling resistance. This parameter is measured by immersing the polymer in a solvent used in printing (e.g., polar organic solvents) for 20 minutes and measuring the degree of volume expansion. The polyurethane of the present invention is highly resistant to attack by such solvents and will not swell more than 5% when tested in these conditions.

Another advantage of the compressible sealant of the present invention is that the compressible sealant can extend into any number of layers, or all of the layers, in the gap. Accordingly, the compressible sealant is useful even when the fabric layers are disposed only in the upper half of the printing blanket.

The present invention also achieves unexpected results by using microspheres in the compressible layer in a range of about 3.5% to about 9% by weight. In a more preferred embodiment, the present invention uses microspheres in the compressible layer in the range of about 4% to about 7.5%. In an even more preferred embodiment, the present invention uses microspheres in the compressible layer in the range of about 5.5% to about 6.5%.

The present invention also has the advantage of operating with a sealant gap that is smaller than that taught in the prior art. A typical sealant gap is approximately 1–3 mm. In contrast, the present invention uses a gap that is in the range of about 0.2 to about 3.0 mm. In a more preferred embodiment, the gap of the present invention is in the rang of about 0.3 to about 1.0 mm. In an even more preferred embodiment, the gap is in the range of about 0.4 to about 0.8 mm. This reduction in gap size translates into great savings in terms of the amount of linear feet of print space per the life of the printing blanket. For example, it is well known in the art that a typical printing blanket will process around 8,000,000 sheets of paper in its lifetime. Since every mm of surface area on the printing blanket can be used to transfer print to the paper, an increase of just 1 mm of available printing surface can make a great difference in the number of pages that can be printed during the life of the printing blanket. The average sealant gap in an ordinary printing blanket is approximately 1.5 mm. The sealant gap in the present invention is around 0.5 mm. This 1 mm of increased surface area on the printing blanket is then multiplied by the 8,000,000 pages that are typically printed in the life of a printing blanket. Thus, 1 mm of extra surface area multiplied by 8,000,000 pages equals 8,000,000 mm of page space that can accept print. This translates to 3,149 inches, 262 ft, or 87.5 yards of page space saved during the lifetime of the printing blanket.

The properties of the compressible sealant, including its relatively low hardness, advantageously allow for substantial tangential and radial compression during printing. This compression is important, especially given the relatively high amount of microspheres incorporated into compressible sealant. As one of ordinary skill in the art knows, a blanket bulge is formed by the centrifugal pressures of the blanket in the print zone. This bulge 50 is detrimental to both the quality of printing and the life of the printing blanket. Such tangential compression reduces bulging by absorbing the tangential pressure exerted on the printing blanket during printing.

The sleeve according to the invention can also be particularly advantageously produced by a welded metal sleeve 3 made of steel or aluminum or, for example, a CFR sleeve with a joint location being used, to which a conventional offset rubber blanket, for example having a compressible layer, is applied, for example adhesively bonded or vulcanized on. After that, the covering layer of the conventional rubber blanket is removed, for example ground off, and in its place a continuous covering layer, that is to say one without a joint, is applied, for example vulcanized on. By comparison with the known sleeves, production of this type and a sleeve construction of this type are substantially more cost-effective and have a number of advantages.

The gaps between layers can be arranged advantageously—but not necessarily—directly above the joint location.

The apparatus according to the invention provides a number of possible uses, which are not restricted just to the application to web-fed rotary offset printing machines. For example, the sleeve 2 can also be used in other indirect printing processes such as indirect gravure, for example, or as a roll.

It is advantageous to apply the sleeve in register. This can be carried out, for example, by the sleeve 2 being pushed on in a predefined circumferential position. For example, there can be a marking on one sleeve end and one transfer-cylinder end which, if brought into coincidence, permit registration. By means of an appropriate, firm seat of the sleeve on the transfer cylinder, it is possible to ensure that the sleeve remains fixed in the register position during operation. Alternatively, it is also possible to ensure registration by means of a form fit, for example by means of a strip 3*a* which is fixed to the inner wall of the metal sleeve 3 and which, during the mounting of the sleeve 2, can be inserted into a slot 17 running axially in the transfer cylinder.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention.

Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto. Substantially extends means extends at least 90%.

What is claimed is:

1. A mountable cylindrical printing blanket apparatus for use with an off-set printing press, said printing blanket apparatus comprising:

an inner carrier sleeve layer;

a printing blanket affixed to the sleeve and comprising:

at least one compressible layer having a first porosity;

at least one printing face layer;

a gap extending axially along the mountable printing blanket having between about 0.2 millimeters and about 2 millimeters in width and a depth substantially extending through at least one layer; and a compressible sealant therein in an amount sufficient to substantially fill the gap, said compressible sealant having a second porosity and having a compressibility in both the radial and in the tangential direction, and wherein the compressible sealant has a compressibility greater than the compressibility of the compressible layer.

2. The printing blanket apparatus of claim 1 wherein the gap is from about 0.2 millimeters and to about 2 millimeters in width, and where the compressible sealant has a compressibility greater than 1.5 times the compressibility of the compressible layer.

3. The printing blanket apparatus of claim 2, further comprising at least one reinforcing layer comprising a fabric, wherein the gap has a depth substantially extending through at least one reinforcing layer, and wherein the compressible sealant has a hardness of from about 50 to about 100 Shore A.

4. The printing blanket apparatus of claim 1 wherein the porosity in the compressible sealant and in the compressible layer each comprises microspheres, and wherein the concentration of microspheres in the compressible sealant is from about 1.25 to about 3 times greater than the concentration of microspheres in the compressible layer.

5. The printing blanket apparatus of claim 1 wherein the gap is from about 0.3 millimeters and to about 1 millimeter in width and has a depth substantially extending through at least the printing face layer.

6. The printing blanket apparatus of claim 1, further comprising at least one reinforcing layer comprising a fabric, wherein the gap is between about 0.3 millimeters and about 1 millimeter in width and has a depth substantially extending through the at least one reinforcing layer.

7. The printing blanket apparatus of claim 1, further comprising at least one reinforcing layer comprising a fabric, wherein the gap is from about 0.3 millimeters to about 1 millimeter in width and has a depth substantially extending through at least the printing face layer and one reinforcing layer.

8. The printing blanket apparatus of claim 7 wherein the compressible sealant comprises a moisture-curable polyurethane and microspheres.

9. The printing blanket apparatus of claim 7 wherein the porosity in the compressible sealant and in the compressible layer each comprises microspheres, and wherein the compressible sealant comprises microspheres in an amount from 4.5% to about 9% by weight, and wherein the concentration of microspheres in the compressible sealant is at least 25% greater than the concentration of microspheres in the compressible layer.

10. The printing blanket apparatus of claim 9 wherein the gap width is between about 0.4 millimeters and about 0.7 millimeters in width.

11. The printing blanket apparatus of claim 10 wherein the concentration of microspheres in the compressible sealant is from about 1.5 to about 3 times greater than the concentration of microspheres in the compressible layer.

12. The printing blanket apparatus of claim 9 wherein the polyurethane has a hardness of from about 50 to about 100 Shore A.

13. The printing blanket apparatus of claim 9 wherein the polyurethane has a viscosity before curing of from about 40 centipoise to about 5000 centipoise.

14. The printing blanket apparatus of claim 1 wherein the compressible sealant comprises a vulcanization-curable rubber formulation and microspheres.

15. The printing blanket apparatus of claim 14 wherein the porosity in the compressible sealant and in the compressible layer each comprises microspheres, and wherein the compressible sealant comprises microspheres in an amount from 4.5% to about 9% by weight, and wherein the concentration of microspheres in the compressible sealant is at least 25% greater than the concentration of microspheres in the compressible layer.

16. The printing blanket apparatus of claim 15 wherein the gap width is from between about 0.4 millimeters to about 0.7 millimeters in width.

17. The printing blanket apparatus of claim 16 wherein the concentration of microspheres in the compressible sealant is from about 1.5 to about 3 times greater than the concentration of microspheres in the compressible layer.

18. The printing blanket apparatus of claim 15 wherein the vulcanization-curable rubber formulation has a hardness of from about 50 to about 140 Shore A after vulcanization, wherein said hardness is measured without the presence of microspheres.

19. A mountable cylindrical printing blanket apparatus for use with an off-set printing press, said printing blanket apparatus comprising:

an inner carrier sleeve layer;

a printing blanket affixed to the sleeve and comprising:

at least one compressible layer comprising a first concentration of microspheres;

at least one reinforcing layer comprising fabric;

at least one printing face layer;

a gap extending axially along the mountable printing blanket having from about 0.2 millimeters to 0.9 millimeters in width and a depth substantially extending through the printing layer and at least one reinforcing layer; and a compressible sealant therein in an amount sufficient to substantially fill the gap, said compressible sealant having a second porosity and having a compressibility in both the radial and in the tangential direction, and wherein the compressible sealant has a compressibility at least about 50% greater than the compressibility of the compressible layer.

20. The printing blanket apparatus of claim 19 wherein the gap is from about 0.4 millimeters to about 0.7 millimeters in width, and wherein the compressible sealant comprises moisture-curable polyurethane and microspheres in an amount from 4.5% to about 9% by weight, and wherein the concentration of microspheres in the compressible sealant is at least 25% greater than the concentration of microspheres in the compressible layer.

21. The printing blanket apparatus of claim 19 wherein the gap is from about 0.4 millimeters to about 0.7 millimeters in width, and wherein the compressible sealant comprises vulcanization-cured rubber and microspheres in an amount from 4.5% and about 9% by weight, and wherein the greater than the concentration of microspheres in the compressible sealant is at least 25% greater than the concentration of microspheres in the compressible layer.

22. A method of forming the blanket of claim 18 comprising the steps of:

providing a sleeve formed into a cylinder and having an outer face;

providing a substantially cured flat printing blanket having a back face and a printing face on opposing sides and dimensioned to cover one side of the metal sleeve;

affixing a layer of adhesive and a release layer to at least one of the back face of the printing blanket, the outer face of the sleeve, or to both;

removing the release layer and affixing the printing blanket back face onto the outer face of the sleeve; using an opposing roller to apply pressure to the printing face of the blanket to squeeze out any air bubbles entrapped between the blanket and the sleeve;

optionally cutting any excess printing blanket off so as to leave a gap of between two opposing edges of the printing blanket, wherein said gap is from about 0.2 millimeters and about 2 millimeters in width;

optionally curing the adhesive;

adding a compressible sealant into the gap, wherein the compressible sealant comprises between about 4.5% and about 10% by weight of the compressible layer; and grinding the surface of at least the compressible sealant to be flush with the top of the printing face.

* * * * *